US011548690B2

(12) United States Patent
Mayer et al.

(10) Patent No.: US 11,548,690 B2
(45) Date of Patent: Jan. 10, 2023

(54) TAMPER-EVIDENT BAG SEAL WITH TABS AND METHODS OF USE

(71) Applicant: Inno-Pak, LLC, Delaware, OH (US)

(72) Inventors: Steven A. Mayer, Indianapolis, IN (US); Jonathan D. Sill, Delaware, OH (US); Nathan Schultz, Westerville, OH (US); Denny V. Tao, Katy, TX (US)

(73) Assignee: Inno-Pak, LLC, Delaware, OH (US)

( * ) Notice: Subject to any disclaimer, the term of this patent is extended or adjusted under 35 U.S.C. 154(b) by 0 days.

(21) Appl. No.: 17/526,847

(22) Filed: Nov. 15, 2021

(65) Prior Publication Data

US 2022/0153478 A1 May 19, 2022

Related U.S. Application Data

(60) Provisional application No. 63/113,254, filed on Nov. 13, 2020.

(51) Int. Cl.

| | |
|---|---|
| ***B65D 33/34*** | (2006.01) |
| ***B65D 33/16*** | (2006.01) |
| ***B65D 30/20*** | (2006.01) |

(52) U.S. Cl.

CPC ..... *B65D 33/34* (2013.01); *B65D 31/10* (2013.01); *B65D 33/1691* (2013.01); *B65D 2401/15* (2020.05)

(58) Field of Classification Search

CPC .... B65D 33/34; B65D 31/10; B65D 33/1691; B65D 2401/15

USPC ..... 383/5

See application file for complete search history.

(56) References Cited

U.S. PATENT DOCUMENTS

| | | | | |
|---|---|---|---|---|
| 1,410,404 | A | 3/1922 | Haines | |
| 1,537,956 | A | 5/1925 | Meyers | |
| 1,792,885 | A | 2/1931 | Andrews | |
| 2,050,967 | A | 8/1936 | Farmer | |
| 2,128,196 | A | 8/1938 | Max | |
| 2,149,030 | A | 2/1939 | Arlington | |
| 2,355,786 | A * | 8/1944 | Dreher | B65D 33/1691 383/22 |

(Continued)

FOREIGN PATENT DOCUMENTS

| | | |
|---|---|---|
| CN | 2347943 Y | 11/1999 |
| DE | 2733041 A1 | 2/1978 |

(Continued)

OTHER PUBLICATIONS

Inno-Pak Handle Cuffs; Announced Aug. 24, 2020 (online). Site visited [Oct. 20, 2021]. Available from internet URL: https://www.Innopak.com/products/handle-cuffs/.

(Continued)

*Primary Examiner* — Jes F Pascua

(74) *Attorney, Agent, or Firm* — Ward and Smith, P.A.; Ryan K. Simmons

(57) ABSTRACT

A tamper-evident bag seal including tabs for separating flaps of the seal along a perforation is provided. The tamper-evident bag seal may be a paper or paperboard panel that folds over the handles of an existing bag and is secured to the sides of the bag. The tamper-evident bag seal includes a fold having perforated sections adjacent centrally located tabs. By pulling the tabs in opposite directions, the perforated sections are compromised, permitting access to bag contents and evidencing tampering of the bag seal.

20 Claims, 8 Drawing Sheets

(56) References Cited

U.S. PATENT DOCUMENTS

| | | | | |
|---|---|---|---|---|
| 2,660,296 | A * | 11/1953 | Dunning | B65D 85/672 206/408 |
| 2,693,836 | A | 11/1954 | Hayes | |
| 2,846,134 | A | 8/1958 | Esber | |
| 2,873,905 | A * | 2/1959 | Denton | B65D 33/14 383/33 |
| 2,934,255 | A | 4/1960 | McDuffie | |
| 3,203,621 | A | 8/1965 | Wright | |
| D205,970 | S | 10/1966 | Leifield | |
| 3,545,668 | A * | 12/1970 | Hultbergwayne | B65D 33/30 383/905 |
| 3,770,188 | A | 11/1973 | Bressickello | |
| D229,485 | S | 12/1973 | Peterson | |
| 3,811,613 | A | 5/1974 | Harrison | |
| D233,083 | S | 10/1974 | Rosa | |
| 4,243,171 | A | 1/1981 | Prin | |
| 4,261,506 | A * | 4/1981 | Scott | B65D 33/14 383/905 |
| 4,276,982 | A | 7/1981 | Sibrava et al. | |
| D277,555 | S | 2/1985 | Pattillo | |
| 4,531,667 | A * | 7/1985 | Meade | B42F 7/08 229/72 |
| 4,723,300 | A | 2/1988 | Aranow | |
| 4,790,670 | A | 12/1988 | Barbaro | |
| 4,955,981 | A | 9/1990 | Provost | |
| 5,035,515 | A | 7/1991 | Crossman et al. | |
| 5,096,113 | A | 3/1992 | Focke | |
| 5,226,941 | A | 7/1993 | Uibel et al. | |
| D372,864 | S | 8/1996 | Hansen | |
| 5,608,949 | A | 3/1997 | Cooley et al. | |
| 5,711,751 | A | 1/1998 | Harmanoglu | |
| 5,824,380 | A | 10/1998 | Hagen | |
| 5,881,432 | A | 3/1999 | Good | |
| D438,797 | S | 3/2001 | Bozlee | |
| D442,085 | S | 5/2001 | Bozlee | |
| 6,286,681 | B1 | 9/2001 | Wifong et al. | |
| D451,389 | S | 12/2001 | Bozlee | |
| 6,361,209 | B1 | 3/2002 | Larue et al. | |
| D462,904 | S | 9/2002 | Mellon | |
| D501,134 | S | 1/2005 | Takahashi et al. | |
| D502,872 | S | 3/2005 | Fleming | |
| 6,913,389 | B2 | 7/2005 | Kannankeril et al. | |
| 7,004,632 | B2 | 2/2006 | Hamilton et al. | |
| 7,090,272 | B2 | 8/2006 | Novakovich | |
| 7,427,161 | B2 | 9/2008 | Sill et al. | |
| 8,033,447 | B2 | 10/2011 | Katch | |
| D739,766 | S | 9/2015 | Glass | |
| 9,434,513 | B2 | 9/2016 | Lux et al. | |
| 9,630,748 | B2 | 4/2017 | Keller | |
| D786,976 | S | 5/2017 | Keating | |
| D801,826 | S | 11/2017 | O'Connor et al. | |
| D811,896 | S | 3/2018 | Wigman et al. | |
| D812,490 | S | 3/2018 | Wigman et al. | |
| D821,223 | S | 6/2018 | Tan | |
| D826,043 | S | 8/2018 | Dacey | |
| D828,763 | S | 9/2018 | Tan | |
| D830,849 | S | 10/2018 | Tan | |
| 10,259,616 | B2 | 4/2019 | Korinek et al. | |
| D860,807 | S | 9/2019 | Sill | |
| 2002/0027357 | A1* | 3/2002 | Lake | B42F 9/002 281/31 |
| 2005/0041894 | A1 | 2/2005 | Hanson | |
| 2005/0047686 | A1 | 3/2005 | Eisaesser | |
| 2006/0045390 | A1 | 3/2006 | Sill | |
| 2006/0196787 | A1 | 9/2006 | Lewis | |
| 2007/0292053 | A1 | 12/2007 | Lin et al. | |
| 2013/0315507 | A1 | 11/2013 | Vidal et al. | |
| 2015/0360821 | A1 | 12/2015 | Greenwood et al. | |
| 2017/0166357 | A1 | 6/2017 | Chandaria | |
| 2019/0112116 | A1 | 4/2019 | Su et al. | |
| 2021/0086950 | A1 | 3/2021 | Sill | |

FOREIGN PATENT DOCUMENTS

| | | | |
|---|---|---|---|
| DE | 29500157 | U1 | 2/1995 |
| DE | 19831584 | A1 | 1/2000 |
| DE | 10-2009-007985 | A1 | 2/2010 |
| EP | 0515086 | A1 | 11/1992 |
| FR | 2838406 | A1 | 10/2003 |
| GB | 487330 | A | 6/1938 |
| JP | 2017-061324 | A | 3/2017 |
| NL | 1040069 | C2 | 8/2014 |
| WO | WO2004071890 | A1 | 8/2004 |

OTHER PUBLICATIONS

International Search Report and Written Opinion from International Application No. PCT/US2019/030891, dated Jul. 26, 2019, 13 pages.

* cited by examiner

TAMPER-EVIDENT BAG SEAL WITH TABS AND METHODS OF USE

RELATED APPLICATIONS

The presently disclosed subject matter claims the benefit of U.S. Provisional Patent Application Ser. No. 63/113,254, filed Nov. 13, 2020, the disclosure of which is incorporated herein by reference in its entirety.

TECHNICAL FIELD

The presently disclosed subject matter is directed towards a method and system for securing containers. Specifically, a tamper-evident bag seal is provided which includes tabs and methods of pulling the tabs to break the bag seal along a perforated fold.

BACKGROUND

Disposable containers for packaging, distributing, displaying or otherwise housing consumer items, such as food containers, are becoming increasingly important. For example, bags, such as paper bags, are used for distributing and/or carrying food items, such as take out or to-go food containers. Sometimes it is desirable that an item or items, such as food containers, be placed in, for example, a bag for ease of transport. Unfortunately, it is a frequent occurrence that the containers may be tampered with by persons who wish to access the item or items in the containers. In taking steps to avoid this invasion of the container, many approaches in the nature of security and/or safety have been utilized. However, some of these security attempts have been easily circumvented and others have been very expensive.

One of the desirable features of security packaging is the characteristic that any tampering with the package produces a "tamper-evident" condition. With a "tamper-evident" condition, a consumer can visually detect that the container has been tampered. Unfortunately, many security attempts have been unsuccessful in that it is not fully evident that the security of the container has been breached. Accordingly, there remains a need for a system and methods for incorporating tamper-evident features onto containers that addresses the various disadvantages of the prior art.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Further, the claimed subject matter is not limited to implementations that solve any or all disadvantages noted in any part of this disclosure.

According to at least one embodiment of the disclosed subject matter, a tamper-evident bag seal is provided. The seal includes two flaps pivotally coupled along a fold with the fold defined by two perforated sections extending from a centrally positioned opening such that the opening defines at least one tab on each of the two flaps.

According to at least one embodiment of the disclosed subject matter, a method for opening a bag secured with the tamper-evident bag seal is provided.

While one or more objects of the presently disclosed subject matter having been stated hereinabove, and which is achieved in whole or in part by the presently disclosed subject matter, other objects will become evident as the description proceeds when taken in connection with the accompanying drawings as best described hereinbelow proceeds when taken in connection with the accompanying drawings as best described hereinbelow.

BRIEF DESCRIPTION OF THE DRAWINGS

The foregoing, as well as the following Detailed Description of preferred embodiments, is better understood when read in conjunction with the drawings included herein. For the purposes of illustration, there is shown in the drawings exemplary embodiments; however, the presently disclosed subject matter is not limited to the specific methods and instrumentalities disclosed. A full and enabling disclosure of the present subject matter including the best mode thereof to one of ordinary skill in the art is set forth more particularly in the remainder of the specification, including reference to the accompanying figures, in which.

Figure 1:
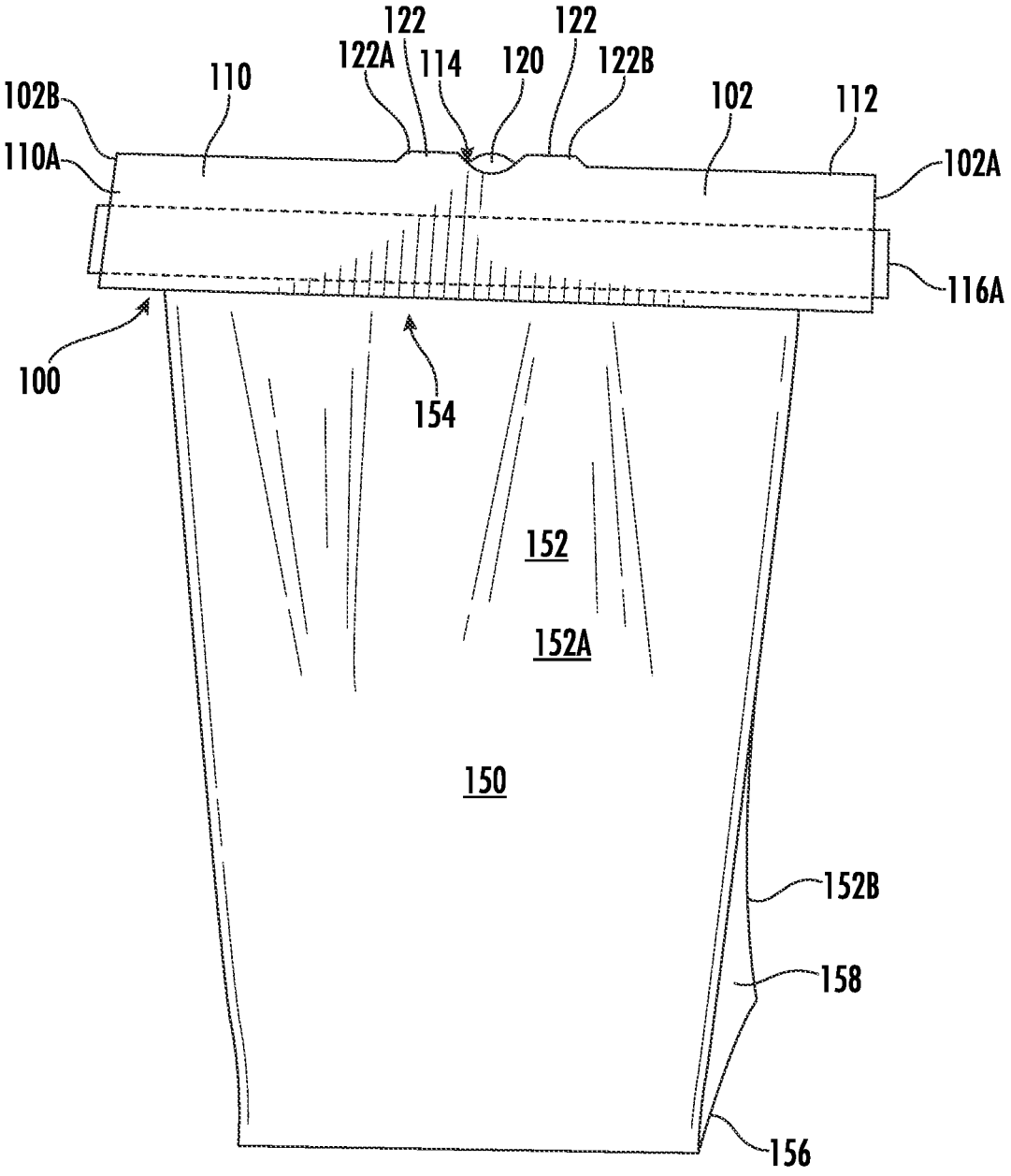
FIG. 1 illustrates a perspective view of a tamper-evident bag seal including tabs partially installed on a bag according to one or more embodiments of the presently disclosed subject matter.

Repeat use of reference characters in the present specification and drawings is intended to represent the seam or analogous features or elements of the present subject matter.

DETAILED DESCRIPTION

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although the term "step" may be expressly used or implied relating to features of processes or methods, no implication is made of any particular order or sequence among such expressed or implied steps unless an order or sequence is explicitly stated.

Although the terms first, second, right, left, front, back, top, bottom, etc. may be used herein to describe various features, elements, components, regions, layers and/or sections, these features, elements, components, regions, layers and/or sections should not be limited by these terms. These terms are only used to distinguish one feature, element, component, region, layer, or section from another feature, element, component, region, layer, or section. Thus, a first feature, element, component, region, layer, or section discussed below could be termed a second feature, element, component, region, layer, or section without departing from the teachings of the disclosure herein.

Similarly, when a feature or element is being described in the present disclosure as "on" or "over" another feature or element, it is to be understood that the features or elements can either be directly contacting each other or have another feature or element between them, unless expressly stated to the contrary. Thus, these terms are simply describing the relative position of the features or elements to each other and do not necessarily mean "on top of" since the relative position above or below depends upon the orientation of the device to the viewer.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth. Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

Embodiments of the subject matter of the disclosure are described herein with reference to schematic illustrations of embodiments that may be idealized. As such, variations from the shapes and/or positions of features, elements, or components within the illustrations as a result of, for example but not limited to, user preferences, manufacturing techniques and/or tolerances are expected. Shapes, sizes and/or positions of features, elements or components illustrated in the figures may also be magnified, minimized, exaggerated, shifted, or simplified to facilitate explanation of the subject matter disclosed herein. Thus, the features, elements or components illustrated in the figures are schematic in nature and their shapes and/or positions are not intended to illustrate the precise configuration of the subject matter and are not necessarily intended to limit the scope of the subject matter disclosed herein unless it specifically stated otherwise herein.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

It is to be understood that the ranges and limits mentioned herein include all ranges located within the prescribed limits (i.e., subranges). For instance, a range from about 100 to about 200 also includes ranges from 110 to 150, 170 to 190, 153 to 162, and 145.3 to 149.6. Further, a limit of up to about 7 also includes a limit of up to about 5, up to 3, and up to about 4.5, as well as ranges within the limit, such as from about 1 to about 5, and from about 3.2 to about 6.5.

As used herein, the term "fold" means a line, crease, or perforation that is used to make a fold in a body of a tamper-evident bag seal or an actual fold that is present in a body of a tamper-evident bag seal after folding on such a line, crease, or perforation.

"Adhesive" or "adhesives" as used herein means substances that are used to secure materials, such as substrates, together by binding or adhering to the materials with which they come in contact and resist separation of the materials even under force. Thus, adhesives are substances that have the ability to secure together non-similar materials or substances by binding and/or adhering to the non-similar materials or substances.

"Adhesive structure" or "adhesive structures" as used herein means an application of adhesive(s) to a substrate in some manner to provides a line of adhesive for attaching a tamper-evident bag seal to a bag. Adhesive structures can include, but is not limited to, adhesive strips, tapes, adhesive applied to a substrate in a pattern, such a dots, lines, ovals, or the like.

The present disclosure provides tamper-evident bag seals and related methods. As disclosed, an embodiment of tamper-evident bag seal can comprise a body having a first end and a second end as well as a first side and a second side. The body can have a length as measured between the first end and the second end and a width as measured between the first side and the second side. The body can comprise a first flap and a second flap with the first and second flaps each having a bag facing side and an outward facing side. The tamper-evident bag seal can also comprise a fold between the first flap and the second flap. The fold can have one or more perforated sections. Further, the tamper-evident bag seal can comprise an opening in a center portion of the body along the perforated fold and between the first flap and the second flap. The opening can be formed between the first flap and the second flap such that the first flap has at least one tab extending from the first flap along the fold and the second flap has at least one tab extending from the second flap along the fold. The bag facing side of the first flap can be configured to be secured to a first side of a bag and the bag facing side of the second flap can be configured to be secured to a second side of the bag such that the fold extends above an opening of the bag and the at least one tab of the first flap and the at least one tab of the second flap extend upward from the fold to provide grips for tearing the body along the one or more perforated sections to access the opening of the bag.

Figure 2:
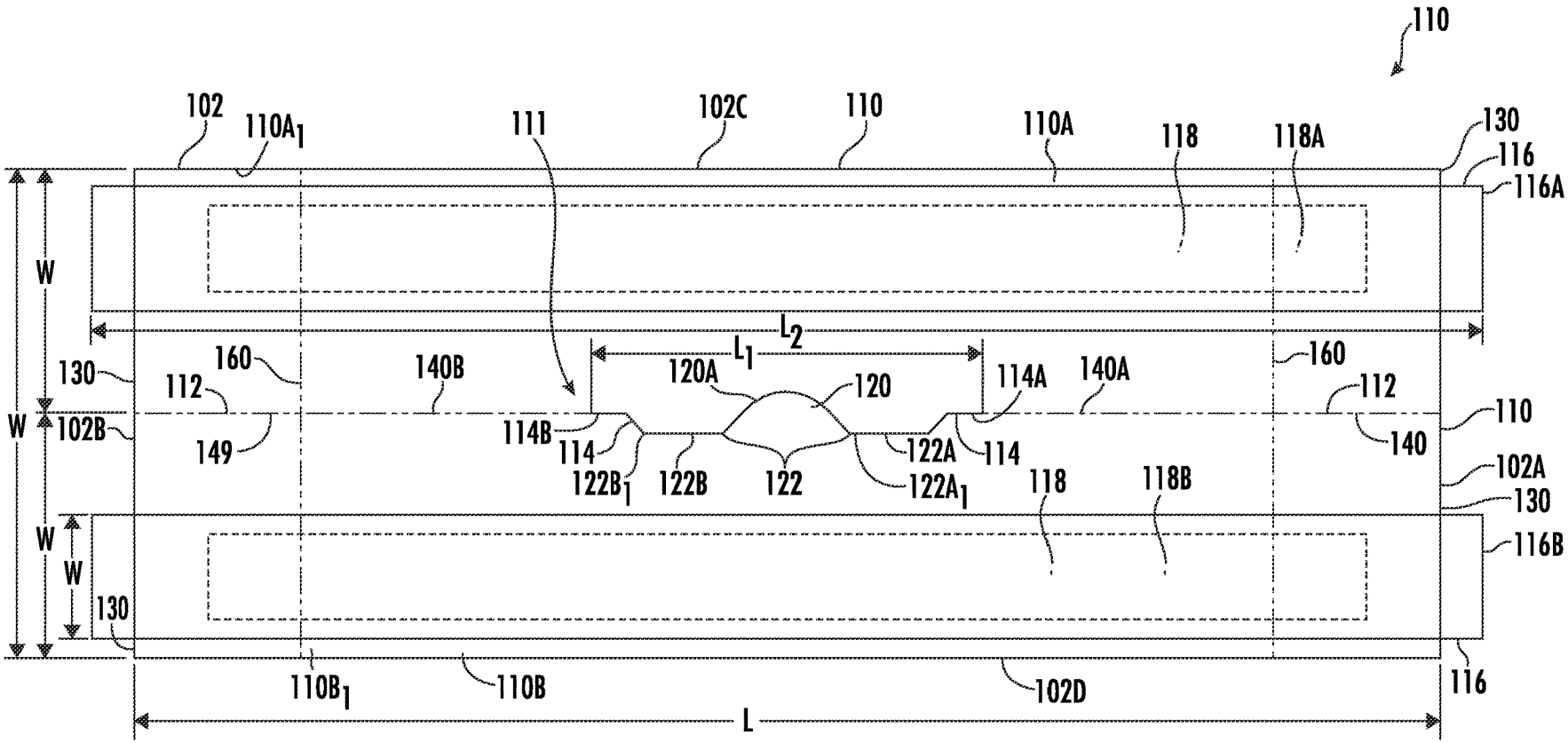
FIG. 2 illustrates a schematic view of the tamper-evident bag seal including tabs and liners in an untampered—with state according to one or more embodiments of the presently disclosed subject matter.

FIGS. 1-8 depict embodiments of a tamper-evident bag seal, generally designated 100. For example, as shown in FIGS. 1 and 2, the tamper-evident bag seal 100 can comprise a body 102 that can have a first end 102A and a second end 102B as well as a first side 102C and a second side 102D. The body 102 can have a length L as measured between the first end 102A and the second end 102B and a width W as measured between the first side 102C and the second side 102D. The body 102 can comprise two panels or flaps 110 pivotally joined to each other at fold 112. Each flap 110 may be rectangular in shape, or may be shaped in any other fashion to conform to the bag 150 to which the seal 100 may be applied. For example, the body 102 can comprise a first flap 110*a* and a second flap 110*b* with the first and second flaps 110*a*, 110*b* each having a bag facing side 110*ai*, 110*bi* and an outward facing side 110*a*2, 110*b*2. The tamper-evident bag seal 100 can also comprise a fold 112 between the first flap 110*a* and the second flap 110*b*. The fold 112 can have one or more perforated sections 140. Further, the tamper-evident bag seal can comprise an opening 114 in a center portion 111 of the body 102 of the tamper-evident bag seal 100 along the fold 112 and between the first flap 110*a* and the second flap 110*b*. The opening 114 can be formed between the first flap 110*a* and the second flap 110*b* such that the first flap 110*a* has at least one tab 120 extending from the first flap 110*a* along the fold 112 and the second flap 110*b* has at least one tab 122 extending from the second flap 110*b* along the fold 112. Each of the tabs 120, 122 may be shaped and sized in any fashion. In some embodiments, the one or more perforated sections 140 comprise a first perforated section 140*a* adjacent a first end 114*a* of the opening 114 and a second perforated section 140*b* on a second end 114*b* of the opening 114 such that when the at least one tab 120 of the first flap 110*a* and the at least one tab 122 of the second flap 110*b* are pulled away from one another, the first and second perforations 140*a*, 140*a* tear to provide evidence of tampering.

Figure 5:
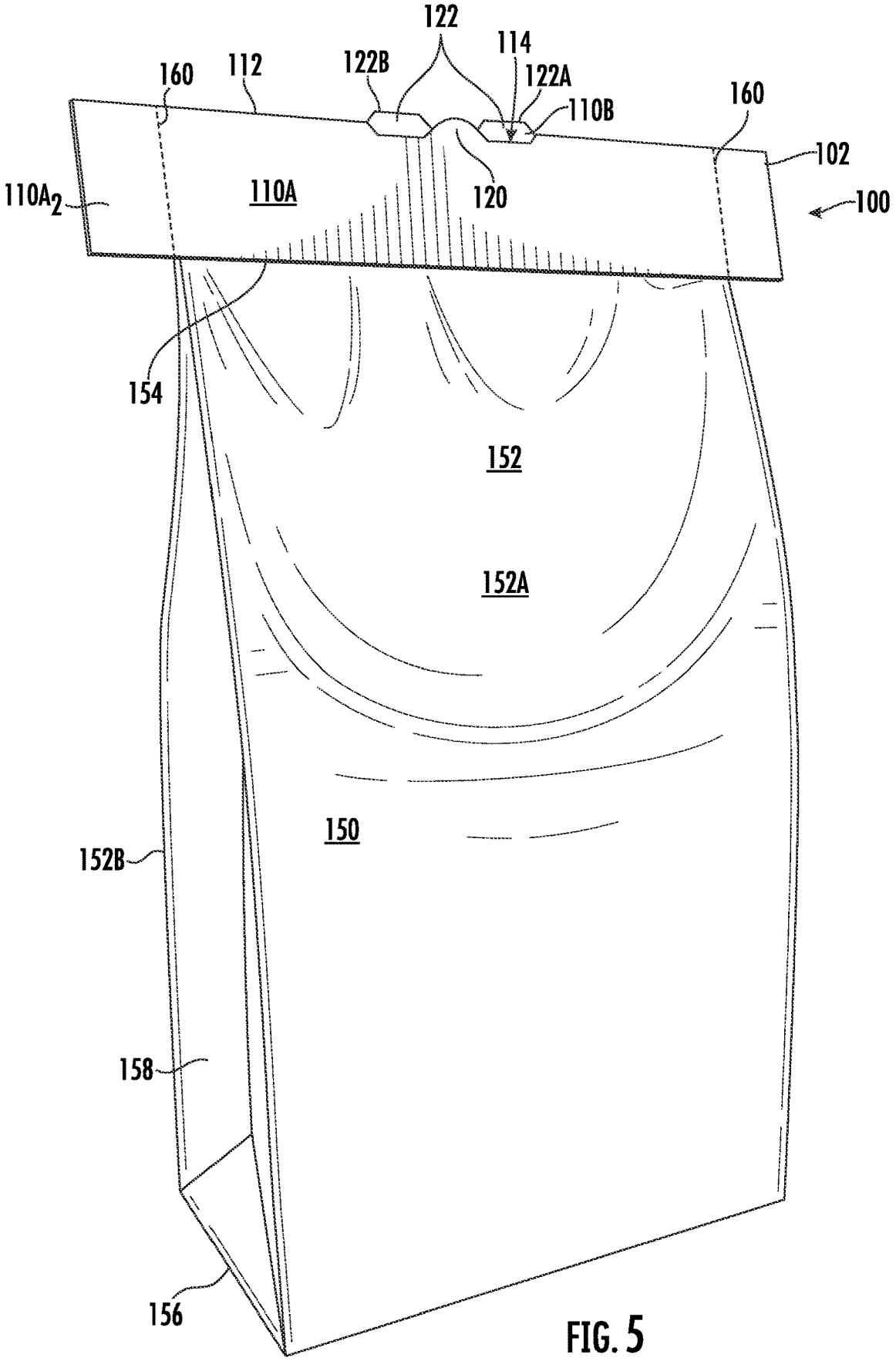
FIG. 5 illustrates a perspective view of the tamper-evident bag seal including tabs fully installed on a bag according to one or more embodiments of the presently disclosed subject matter.
Figure 6:
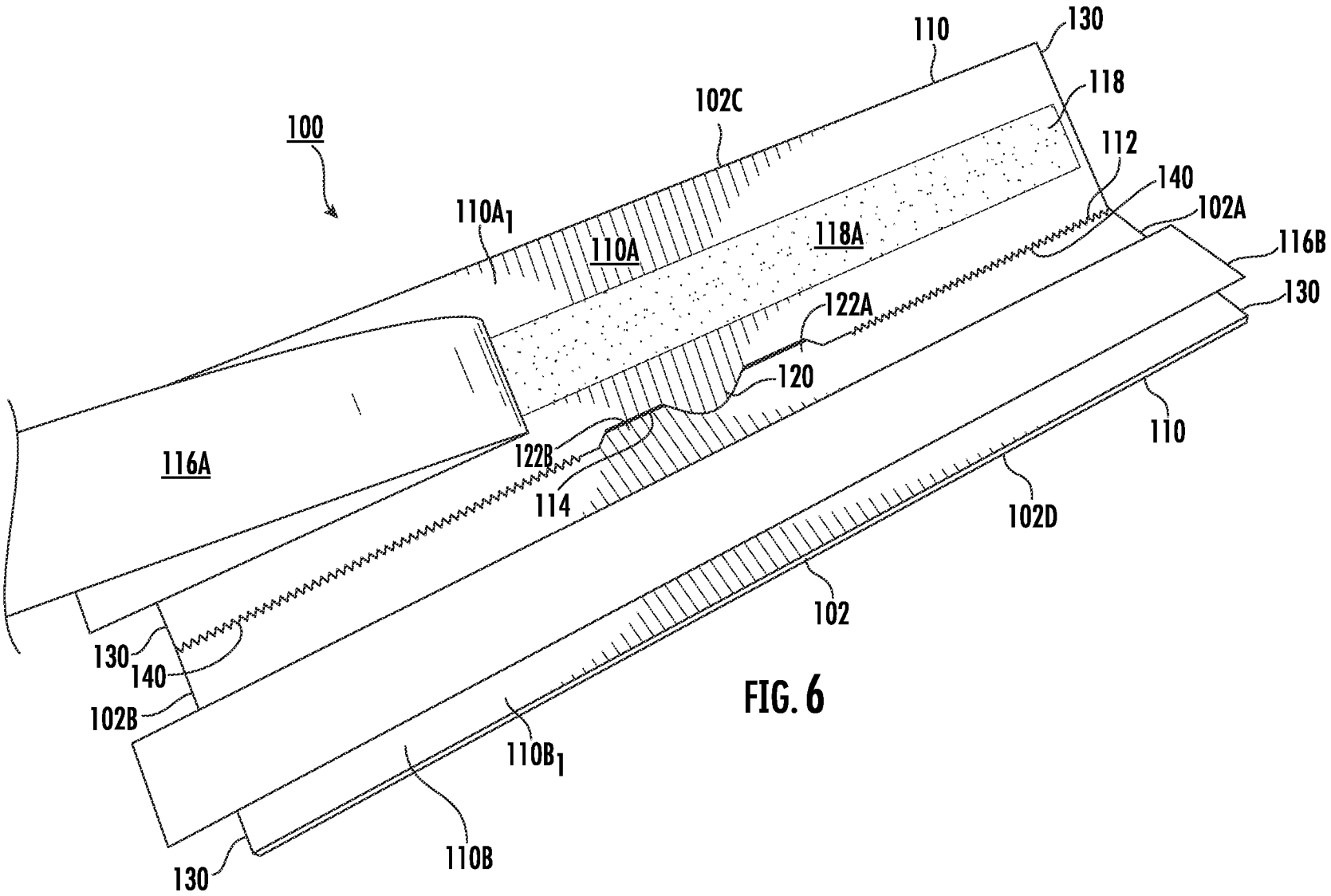
FIG. 6 illustrates a bottom perspective view of the tamper-evident bag seal where a liner is partially removed according to one or more embodiments of the presently disclosed subject matter.
Figure 7:
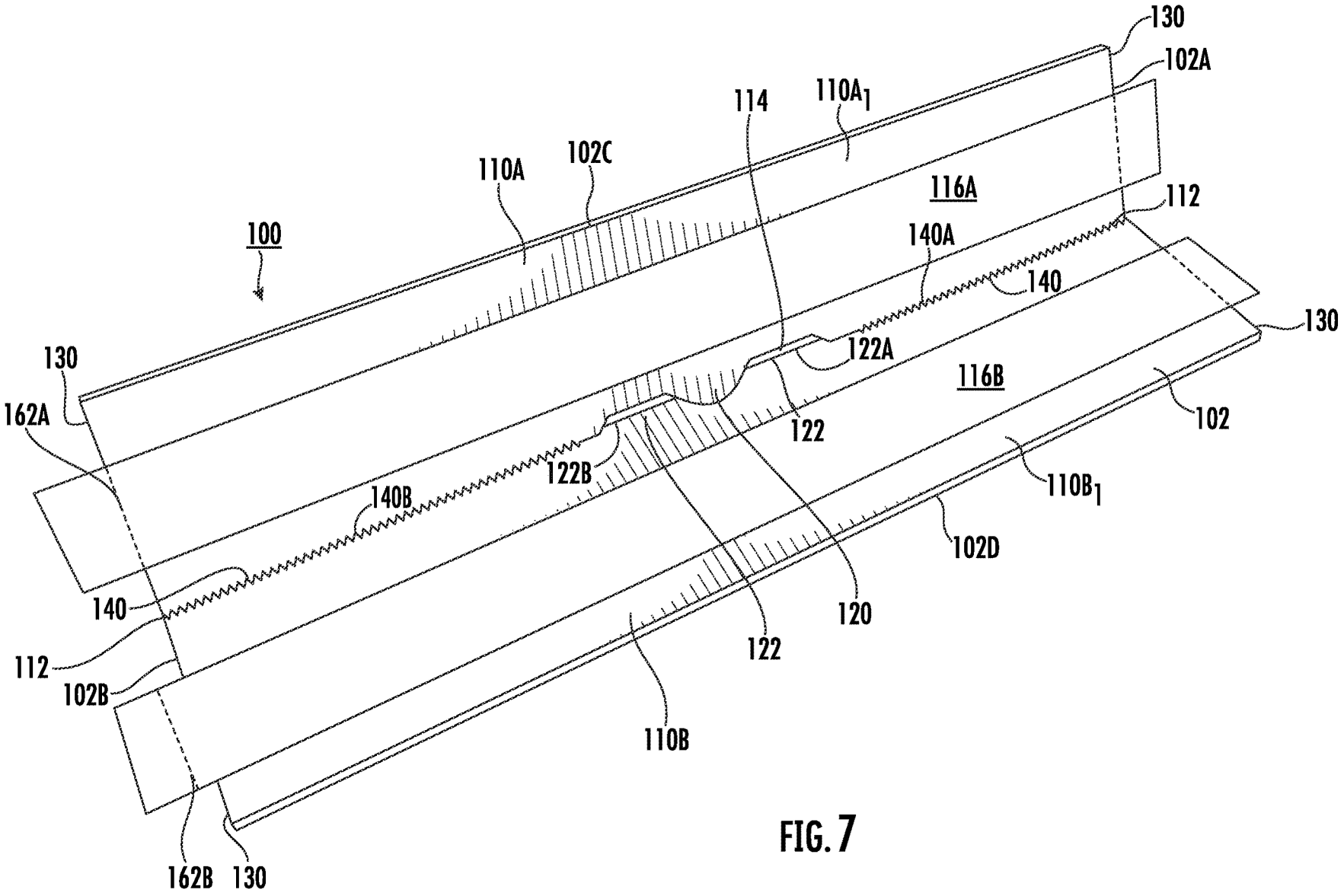
FIG. 7 illustrates a bottom perspective view of the tamper-evident bag seal with a liner removed according to one or more embodiments of the presently disclosed subject matter.
Figure 8:
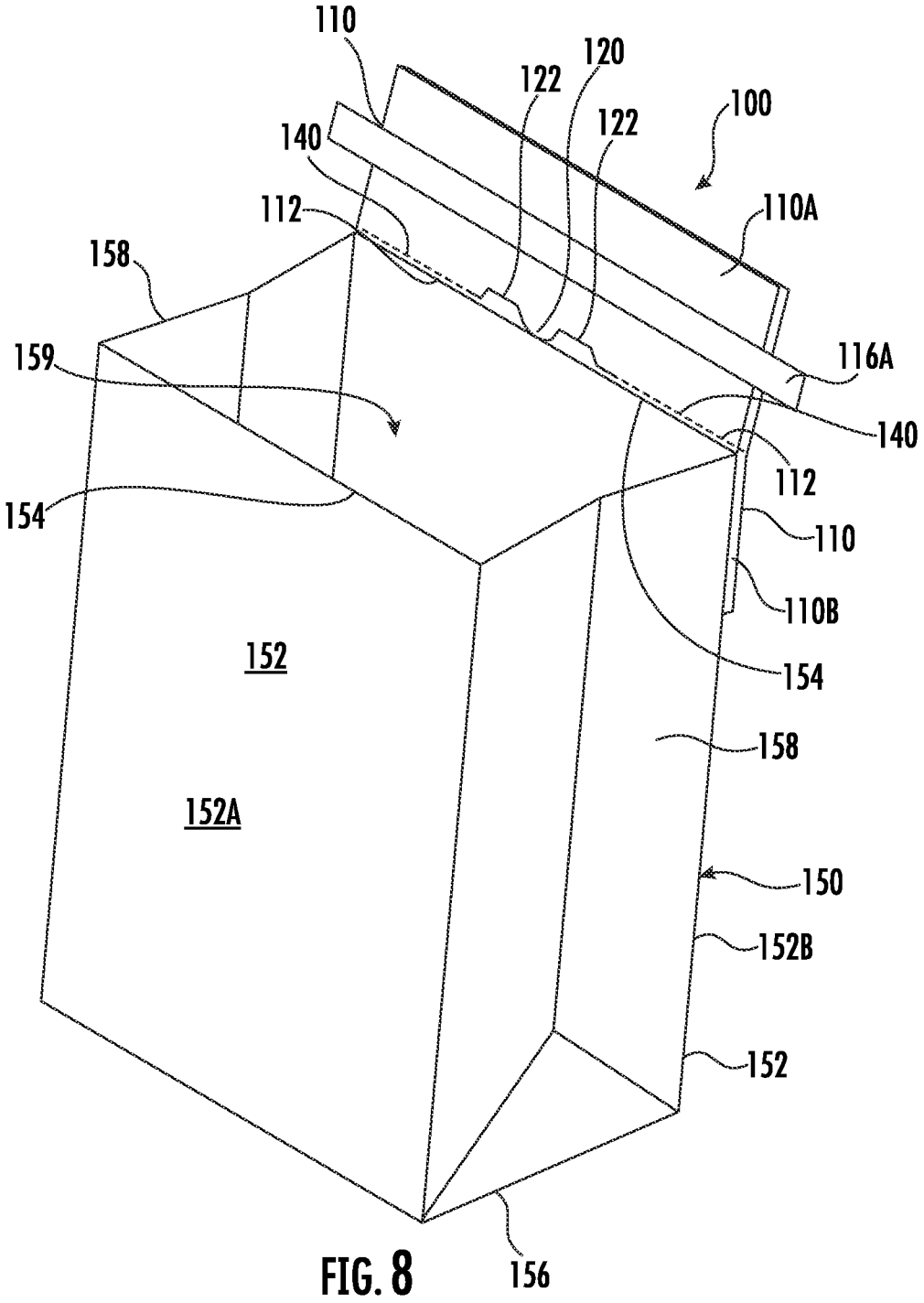
FIG. 8 illustrates a perspective view of the tamper-evident bag seal partially installed on a bag before folding occurs along a fold in the body of the tamper-evident bag seal according to one or more embodiments of the presently disclosed subject matter.

As shown in FIGS. 1,5, and 8, a bag 150 having side walls 152 (first side wall 152*a* and second side wall 152*b*) that have end edges 154, a bottom 156 and two opposing end walls 158. The side walls 152 and the two opposing end walls 158 form an opening 159 at the end edges 154 where contents can be inserted into the bag 150. In some embodiments, the bag seal 100 may be provided as an addon device to an existing bag 150 that otherwise does not include a tamper-evident feature. The bag facing side 110*ai* of the first flap 110*a* can be configured to be secured to the first side 152*a* of the bag 150 and the bag facing side 110*bi* of the second flap 110*b* can be configured to be secured to the second side 152*b* of the bag 150 such that the fold 112 extends above the opening 159 of the bag 150 to seal the bag 150.

FIG. 8 depicts the tamper-evident bag seal 100 partially installed on a bag 150 such that the bag facing side 110*bi* of the second flap 110*b* is secured to the second side 152*b* of the bag 150 but before the body 102 of the bag seal 100 is folded along the fold 112. FIG. 1 depicts the tamper-evident bag seal 100 partially installed on a bag 150 with the ends 154 of at the opening 159 of the bag 150 brought together to effective close the opening 159 with the body 102 of the bag seal 100 being folded along the fold 112 but before the bag facing side 110*ai* of the first flap 110*a* being secured to the first side 152*a* of the bag 150. Once the body 102 of the bag seal 100 is folded along the fold 112, the at least one tab 120 of the first flap 110*a* and the at least one tab 122 of the second flap 110*b* can extend upward from the fold 112 to provide grips for tearing the body 102 of the tamper-evident bag seal 100 along the one or more perforated sections 140 to access the opening 159 of the bag 150. FIG. 5 depicts the tamper-evident bag seal 100 including tabs 120, 122, where the bag seal 100 is fully installed on a bag 150 with the bag facing side 110*ai* of the first flap 110*a* being secured to the first side 152*a* of the bag 150. Once fully installed on the bag 150, the bag seal 100 provides a tamper evident sign or indicator that the bag has been opened and potentially that the contents of the bag 150 have been tampered with. The tamper-evident bag seal 100 can, for example, provide evidence of tampering with the one or more perforated sections 140. A tear along the one or more perforated sections 140 would be considered breaking the seal and can show that tampering with the bag 150 and/or its contents has occurred. In this manner, the one or more perforated sections 140 can comprise a tamper-evident feature.

The tamper-evident bag seal 100 may be, for example, a paper or paperboard panel (or any other suitable material) that folds over the ends 154 of an existing bag 150 and may be secured to the sides 152 of the bag 150. In some embodiments, tamper-evident bag seal 100 may be made of 0.012-inch thick cardboard (or any other suitable material and/or thickness). The tamper-evident bag seal 100 may be provided in different sizes (e.g., small, medium and large) that correlate to different size bags 150. The tamper-evident bag seal 100 may be used with bags 150 without handles. The tabs 120, 122 can be used to open the tamper-evident bag seal 100 and the bag 150.

According to some embodiments, each flap 110 may include an adhesive 118 on a bag facing side for selectively coupling the flap 110 to a side 152 of the bag 150. The adhesive 118 can comprise adhesive structures. For example, the adhesive 118 may include an adhesive strip, such as a strip of double-sided tape, an adhesive compound, or any other suitable adhesive technique, material and/or mechanism. For instances, in some embodiments, the adhesive structure 118 can comprise a double-sided tape comprises a 4-ply tape. In some embodiments, the adhesive 118 can comprise an adhesive structure 118*a* on the bag facing side 110*ai* of the first flap 110*a* and an adhesive structure 118*b* on the bag facing side 110*b*1 of the second flap 110*b* such that the adhesive structures 118*a*, 118*b* are configured to secure the respective first and second flaps 110*a*, 110*b* to respective first and second sides 152*a*, 152*b* of a bag 150.

The adhesive 118 may be wholly covered by a tear-away liner 116 for minimizing accidental contact with the adhesive 118. In particular, in some embodiments, the adhesive 118 can comprise an adhesive strip 118*a*, such as double-sided tape, on the first flap 110*a* covered by a liner 116*a* and an adhesive strip 118*b*, such as double-sided tape, on the second flap 110*b* covered by a liner 116*b*. The liners 116 may extend a distance longer than a length of the adhesive 118 for enabling ease of removal from the adhesive 118. In some embodiments, the liners 116 can extend beyond at least one of the first end 102A or the second end 102B of the body 102. For example, the liners 116 may extend beyond one or both edges 130 of the corresponding flap 110 for enabling easier removal from the adhesive 118. The adhesive 118 and liner 116 may be positioned distal the fold 112 on one or both flaps 110.

Referring to the embodiments depicted in FIGS. 1-5, in some embodiments, the at least one tab 120 of the first flap 110*a* can comprise a central tab 120 and the at least one tab 122 of the second flap 110*b* comprises a first side tab 122*a* and a second side tab 122*b* with the central tab 120 being positioned to be between the first side tab 122*a* and the second side tab 122*b* when the body 102 is folded along the fold 112 and the first and second flaps 110*a*, 110*b* can be attached to the first and second sides 152*a*, 152*b* of a bag 150. In some embodiments, the central tab 120 can have a curved outer edge 120*a* such that the outer edge 120*a* of the central tab 120 can be a semi-circular segment that extends upward from the fold 112 when the body 102 is folded along the fold 112 and the first and second flaps 110*a*, 110*b* are attached to the first and second sides 152*a*, 152*b* of the bag 150. In some embodiments, the first side tab 122*a* and the second side tab 122*b* can each have a similar shape as compared to each other. The shape and the size of the central tab 120, the first side tab 122*a*, and the second side tab 122*b* can be such that the tabs 120, 122*a*, 122*b* can be easily gripped, or grasped, between the fingers of a user who has received the bag 150 so that the user can pull the central tab 120 away from the first side tab 122*a*, and the second side tab 122*b* to gain access to the interior of the bag 150. For example, as shown in FIG. 1-5, in some embodiments, the first side tab 122*a* and the second side tab 122*b* can each have an outer edge 122*ai*, 122*bi* such that the outer edge 122*ai* of the first side tab 122*a* and the outer edge 122*bi* of the second side tab 122*b* can be trapezoidal shaped segments that extend upward from the fold 112 when the body 102 is folded along the fold 112 and the first and second flaps 110*a*, 110*b* are attached to the first and second sides 152*a*, 152*b* of a bag 150. Thus, each of the tabs 120, 122*a*, 122*b* can be wider at a base proximal to the fold 112 than at the end of each of the tabs 120, 122*a*, 122*b* that extend upward from and is distal to the fold 112.

The configuration of the cut that forms the opening 114 and the tabs 120, 122*a*, 122*b* can also be such the widths of the bases of adjacent the tabs 120, 122*a*, 122*b* overlap which, in some embodiment, can provide structural stability when the tabs 120, 122*a*, 122*b* are being pulled apart to open the bag seal 100. In some embodiments, the tabs 120, 122*a*, 122*b* can be a height that facilitates the grasping the tabs 120, 122*a*, 122*b* while reducing the opportunity for the tabs 120, 122*a*, 122*b* to be accidently snagged in a manner that causes an inadvertent tear along the one or more perforations. For example, in some embodiments, the tabs 120, 122*a*, 122*b* can have a height as measured from the fold 112 of about 0.5 inches. In some embodiments, the tabs 120, 122*a*, 122*b* can have a height as measured from the fold 112 of about 0.25 inches. In some embodiments, the tabs 120, 122*a*, 122*b* can have a height as measured from the fold 112 of about 0.125 inches.

Due to each of the tabs 120, 122*a*, 122*b* overlapping the fold 112, an edge of a central portion of the flap 110*a* on either side of the central tab 120 is deeper than the edges of the flap 110*a* along the fold 112 making the height of the central tab 120 larger as measured from a base at the edge of a central portion of the flap 110*a* on either side of the central tab 120 compared the height of the central tab 120 as measured from the fold line 112. Similarly, an edge of a central portion of the flap 110*b* between the side tabs 122*a*, 122*b* is deeper than the edges of the flap 110*b* along the fold 112 such that inner side edges of the side tabs 122*a*, 122*b* are longer that outer edges of the tabs 122*a*, 122*b* that extend to the fold 112.

Figure 3:
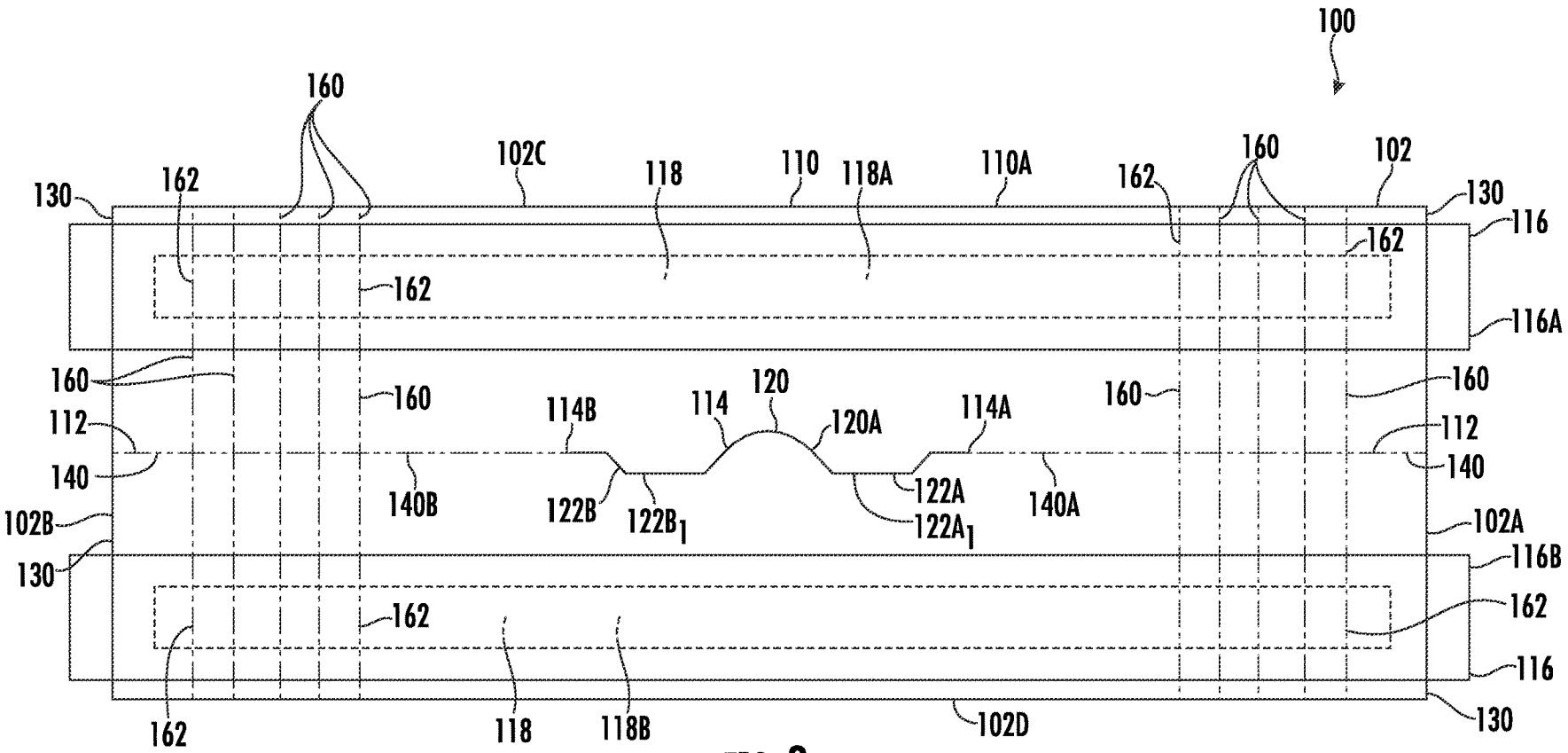
FIG. 3 illustrates a schematic view of the tamper-evident bag seal including tabs with multiple vertical perforations in an untampered—with state according to one or more embodiments of the presently disclosed subject matter.

As shown in FIGS. 2 and 3, the body 102 of the tamper-evident bag seal 100 can be provided as a blank with the one or more perforated sections 140 and the opening 114 formed therein. The opening 114 can be cut along an axis of the fold 112. The fold 112 may include two opposing perforated sections 140*a*, 140*b* abutting an opening 114 positioned in a central portion 111 of the body 102 of the tamper-evident bag seal 100 along the fold 112. Such a configuration permits the opening 114 to be positioned centrally in relation to the bag 150 when the seal 100 is installed on the bag 150. The opening 114 may define the central tab 120 and two abutting side tabs 122 (e.g., 122*a*, 122*b*). Before folding, each of the tabs 120, 122 are in the same plane of the fold 112 and the body 102. The tab 120 of the first flap 110*a* and the tabs 122 of the second flap 110*b* is configured to automatically move from a first position as shown in FIGS. 2 and 3 to a second position as shown in FIGS. 4 and 5 as a result of folding the body 102 of the tamper-evident bag seal 100 along the fold 112 such that the tabs 120, 122 of the first and second flaps 110*a*, 110*b* can be grasped between fingers of a user to pulled the first and second flaps 110*a*, 110*b* away from one another when accessing the opening 159 of the bag 150.

Figure 4:
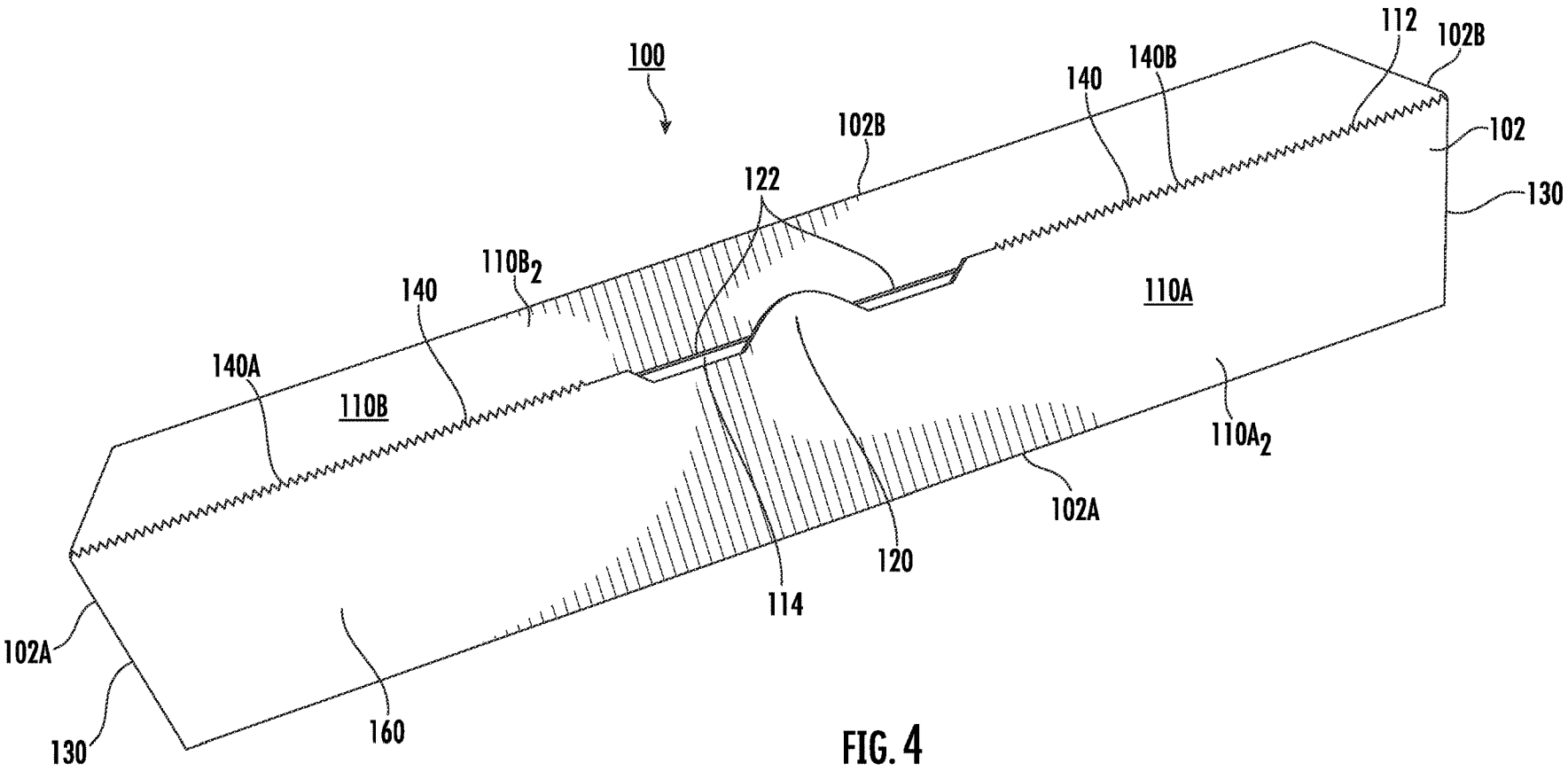
FIG. 4 illustrates a top perspective view of the tamper-evident bag seal including tabs according to one or more embodiments of the presently disclosed subject matter.

Turning back to FIG. 2, and referring also to FIG. 4, the one or more perforated sections 140 can comprise one or more resizing perforations 160 that extend transverse to the fold 112. For example, the bag seal 100 may define two resizing perforations 160 that can extend across both flaps 110 and arranged about perpendicular to the fold 112. The resizing perforations 160 can be about equidistantly positioned on each side of the opening 114. In some embodiments, the resizing perforations 160 can be positioned a specific distance from each other to match the width of a particular bag 150. In such a configuration, the tamper-evident seal 100 may be torn along each of the resizing perforations 160 to resize a width of the bag seal 100. Similarly, in some embodiments, the liners 116 may or may not include liner perforation(s) 162 about parallel and overlapping the vertical perforation(s) 160 so that liners 116 can be resized along with the any resizing of the seal 100 (see FIG. 7, 162*a*). In alternative embodiments, the liner perforation(s) 162 may be parallel and offset from the vertical perforation(s) 160 so that the liner 116 remains extending beyond the flap edge 130 (see FIG. 7, 162*b*).

FIG. 3 illustrates another embodiment of the body 102 of the tamper-evident bag seal 100 that can include multiple resizing perforations 160, thereby permitting a number of resizing options for the bag seal 100. Though FIG. 3 depicts the resizing perforations 160 being about equidistant from each other, the resizing perforations 160 may be positioned at any distance from each other. In some embodiments, liner perforations 162 may also be provided which are about parallel and overlap corresponding resizing perforations 160. The resizing perforations 160 can also act tear-assist perforations. The adhesive 18 that resides on the bag facing side 110*ai*, 110*b*1 of the first and second flaps 110*a*, 110*b* can have a durability and sturdiness that make the adhesive hard to tear through in combination with the substrate of the bag seal 100. By perforating the body of the bag seal with the die during the die cut and then applying the adhesive 18 after the forming the resizing perforations 160, the tearing of the bag seal 100 including the adhesive 18 along the resizing perforations 160 can be facilitated. In this manner, the resizing perforations 160 are also tear assist structures that aid in the tearing of the bag seal 100.

Referring to FIG. 2, generally, the body 102 of the tamper-evident bag seal 100 has an overall length L and an overall width W. In some embodiments, the width W of the body 102 of the tamper-evident bag seal 100 can be about 3 inches. In some embodiments, the length L of the body 102 of the tamper-evident bag seal 100 can be about 8 inches. In some embodiments, the length L of the body 102 of the tamper-evident bag seal 100 can depend on the width of the bag on which it the seal 100 is to be used as measure across the opening between the end walls. Further, each panel or flap 110 has a length that is the same or about the same as length L of the body 102 while each panel or flap 110 can have a width w. In some embodiments, the width W can be equal to about twice the width w of each flap 110. Additionally, the opening 114 can have a length $L_1$ which can be defined as the distance between the two further extensions of any tab 120, 122 into the flap 110 in opposite directions. For example, the length $L_1$ of the opening 114 can range from about 1.5 inches to about 4 inches. In some embodiments, the length $L_1$ of the opening 114 can be about 2 inches. Further, in some embodiments, each liner 116 can have a length $L_2$ and width $w_2$. In some embodiments, the length $L_2$ of the liner 116 can be greater than the length L of the body 102 of the tamper-evident bag seal 100. In some embodiments, the lengths L of the liners 116 can be about 0.25 inches greater than the length L of the body 102 of the tamper-evident bag seal 100. The widths $w_2$ of the liners 116 may be range from about 0.75 inches to about 1 inch in some embodiments.

As outlined above, using the resizing perforations 160, the tamper-evident bag seal 100 may be torn to a particular length to more precisely fit any particular bag 150. Further, different sized tamper-evident bag seals 100 may be used with different sized bags 150. For example, in some embodiments, the body 102 of the tamper-evident bag seal 100 may be designed to fit on a bag 150 having a width of about 8 inches to about 10 inches. In other examples, in some embodiments, the seal 100 may be designed to fit a bag 150 having of width of 12-inches to 14-inches. In yet other embodiments, the seal 100 may be designed to fit a bag 150 having of width of 15-inches to 19-inches.

In operation and referring now again to FIGS. 1, 5, and 8, the following steps may be performed: (1) the bag 150 is provided with some contents already inside, (2) the tamper-evident bag seal 100 is provided, (3) the two bag ends 154 of each bag side 152 are brought together, (4) the opening 114 of the bag seal 100 is centrally aligned between or on the abutting ends 154, (5) one flap 110 (e.g., flap 110*b*) is adhered to one side 152*b* of the bag 150 via removal of the liner 116*b*, (6) the tamper-evident bag seal 100 is folded over bag 150 at the fold 112, (7) the other flap 110 (e.g., flap 110*a*) is adhered to the other side 152*a* of bag 150 via removal of the liner 116*a*, and (8) pressure may be applied to each flap 110 to ensure the adhesive 118 is adjoined to the correspondent bag side 152. Accordingly, the tamper-evident bag seal 100 is used to seal the bag 150.

To open bag 150 in a closed or sealed state, where the perforated sections remain intact and uncompromised, a user may grasp one or more of the tabs 120, 122 and can pull at least one or more of the tabs 120, 122 away from the opening 114 and/or other tabs 120, 122. For example, the central tab 120 may be grasped and separated from the side tabs 122, thereby tearing (or compromising) the perforated sections 140 as the opening 114 is stretched apart. Following the tear of the perforated sections 140, the bag 150 is in a "tamper-evident" condition since it may have been opened and the contents removed.

Alternatively stated, after the contents are placed into the bag 150, the fold-over seal 100 that fits the bag 150 (e.g., small, medium and large) fits over the ends 154 of the bag sides 152, the liner 116 covering the adhesive 118 may then be removed from each flap 110 of the seal 100 (see FIG. 6, 116*a*), and then the flaps 110 may be folded over and secured to the sides 152 of the bag 150. Accordingly, the tamper-evident bag seal 100 is used to seal the bag 150 until fold 112 is torn apart using the central tab 120 and/or side tabs 122, allowing access to the contents. Further, the fold 122 of the fold-over sea 100 may be perforated to provide a tear line along the perforated sections 140. Accordingly, the tamper-evident bag seal 100 is used to seal the bag 150 until the tabs 120, 122 are pulled in opposite directions tearing the seal 100 at the perforations 140 and allowing access to the contents.

In summary, tamper-evident bag seal 100 includes tabs 120, 122 and abutting perforated sections 140 for providing a mechanism for compromising the seal 100 and opening the bag 150. The compromised perforated sections 140 (and the separation of the central tab 120 from the side tabs 122) provide apparent visual evidence that bag 150 has been opened or tampered with. Accordingly, the tamper-evident bag seal 100 with the one or more perforated sections 140 and tabs 120, 122 provide tamper-evident features of bag 150 that otherwise does not include a tamper-evident feature.

Thus, as provided above, methods of using a tamper-evident bag are disclosed herein. For example, in one embodiment, a method of using a tamper-evident seal can comprise providing a bag having a bottom, a first side wall, a second side wall and two opposing end walls that form an opening and providing tamper-evident bag seal. The tamper-evident seal can comprise a body having a first end and a second end and a first side and a second side and having a length as measured between the first end and the second end and a width as measured between the first side and the second side, the body comprising a first flap and a second flap with the first and second flaps having a bag facing side and an outward facing side. The tamper evident bag seal can comprise a fold between the first flap and the second flap. The fold can have one or more perforated sections. For example, in some embodiments, the one or more perforated sections can comprise a first perforated section on a first end of the opening and a second perforated section on a second end of the opening. The tamper evident bag seal can comprise an opening provided in a center portion of the body along the perforated fold and between the first flap and the second flap. The opening can be formed between the first flap and the second flap such that the first flap has at least one tab extending from the first flap along the fold and the second flap has at least one tab extending from the second flap along the fold.

The method can comprise inserting contents into the opening of the bag and attaching the bag facing side of the first flap of the body of the tamper-evident bag seal to the first side wall of the bag proximate to the opening. The body of the tamper-evident bag seal can then be folded over the opening of the bag such that the at least one tab of the first flap and the at least one tab of the second flap extend upward from the fold. The bag facing side of the second flap of the body of the tamper-evident bag seal can then be attached to the second side wall of the bag such that the fold extends above an opening of the bag and the at least one tab of the first flap and the at least one tab of the second flap provide grips for tearing the body along the one or more perforated sections to access the opening of the bag. The at least one tab of the first flap and the at least one tab of the second flap can be pulled away from each other to tear the body along the one or more perforated sections to access the opening of the bag. When the at least one tab of the first flap and the at least one tab of the second flap are pulled away from one another, the first and second perforations tear to provide evidence of tampering.

In some embodiments, the tamper evident bag seal further comprises an adhesive structure on the bag facing side of the first flap and an adhesive structure on the bag facing side of the second flap. Liners are also provided that cover the adhesive structure on the bag facing side of the first flap and the adhesive structure on the bag facing side of the second flap to prevent the adhesive structures from sticking to the bag, or other items, until the liners are removed. The liners can extend upon at least one of the first end or the second end of the body of the tamper-evident bag seal. In such embodiments, the step of attaching the bag facing side of the first flap of the body of the tamper-evident bag seal can comprise removing the liner from the adhesive structure on the bag facing side of the first flap and pressing the first flap and the adhesive structure against the first side wall of the bag. Similarly, the step of attaching the bag facing side of the second flap of the body of the tamper-evident bag seal further comprises removing the liner from the adhesive structure on the bag facing side of the second flap and pressing the second flap and the adhesive structure against to the second side wall of the bag.

In some embodiments, the body of the tamper-evident bag seal can comprise one or more resizing perforations that extend transverse to the fold. In such embodiments, the method of using the tamper-evident bag seal can also include tearing the tamper-evident bag seal along at least one of the one or more resizing perforations to resize the tamper-evident bag seal to fit the size of the bag.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments±100%, in some embodiments±50%, in some embodiments±20%, in some embodiments±10%, in some embodiments±5%, in some embodiments±1%, in some embodiments±0.5%, and in some embodiments±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. As stated above, the recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

The invention claimed is:

1. A tamper-evident bag seal comprising:

a body having a first end and a second end and a first side and a second side and having a length as measured between the first end and the second end and a width as measured between the first side and the second side, the body comprising a first flap and a second flap with the first and second flaps having a bag facing side and an outward facing side;

a fold between the first flap and the second flap, the fold having one or more perforated sections;

an opening provided in a center portion of the body along the fold and between the first flap and the second flap, the opening formed between the first flap and the second flap such that the first flap has at least one tab extending from the first flap along the fold and the second flap has at least one tab extending from the second flap along the fold; and wherein the bag facing side of the first flap is configured to be secured to a first side of a bag and the bag facing side of the second flap is configured to be secured to a second side of the bag such that the fold extends above an opening of the bag and the at least one tab of the first flap and the at least one tab of the second flap extend upward from the fold to provide grips for tearing the body along the one or more perforated sections to access the opening of the bag.

2. The tamper-evident bag seal of claim 1, wherein the one or more perforated sections comprise a first perforated section on a first end of the opening and a second perforated section on a second end of the opening such that when the at least one tab of the first flap and the at least one tab of the second flap are pulled away from one another, the first and second perforations tear to provide evidence of tampering.

3. The tamper-evident bag seal of claim 2, wherein the at least one tab of the first flap comprises a central tab and the at least one tab of the second flap comprises a first side tab and a second side tab with the central tab being positioned to be between the first side tab and the second side tab when the body is folded along the fold and the first and second flaps are attached to the first and second sides of the bag.

4. The tamper-evident bag seal of claim 3, wherein the central tab has a curved outer edge such that the outer edge of the central tab is semi-circular when the body is folded along the fold and the first and second flaps are attached to the first and second sides of the bag.

5. The tamper-evident bag seal of claim 3, wherein the first side tab and the second side tab have a similar shape.

6. The tamper-evident bag seal of claim 5, wherein the first side tab and the second side tab each have an outer edge such that the outer edge of the first side tab and the outer edge of the second side tab is trapezoidal when the body is folded along the fold and the first and second flaps are attached to the first and second sides of the bag.

7. The tamper-evident bag seal of claim 5, wherein each of the central tab, the first side tab, and the second side tab is configured to automatically move from a first position to a second position as a result of folding the body along the fold such that the central tab, the first side tab, and the second side tab are graspable between fingers of a user to pull away the central tab and at least one of the first or second side tabs from one another when accessing the opening of the bag.

8. The tamper-evident bag seal of claim 1, wherein the one or more perforated sections comprise a tamper-evident feature.

9. The tamper-evident bag seal of claim 1, wherein each of the at least one tab of the first flap and the at least one tab of the second flap is configured to automatically move from a first position to a second position as a result of folding the body along the fold such that the at least one tab of the first flap and the at least one tab of the second flap are graspable between fingers of a user to pulled away the first and second flaps from one another when accessing the opening of the bag.

10. The tamper-evident bag seal of claim 1, further comprising an adhesive structure on the bag facing side of the first flap and an adhesive structure on the bag facing side of the second flap, the adhesive structures configured to secure the respective first and second flaps to respective first and second sides of a bag.

11. The tamper-evident bag seal of claim 10, wherein the adhesive structures comprise strips of double-sided tape.

12. The tamper-evident bag seal of claim 11, wherein the double-sided tape comprises a 4-ply tape.

13. The tamper-evident bag seal of claim 10, further comprising liners that cover the adhesive structure on the bag facing side of the first flap and the adhesive structure on the bag facing side of the second flap to prevent the adhesive structures from sticking to the bag until the liners are removed, the liners extending beyond at least one of the first end or the second end of the body.

14. The tamper-evident bag seal of claim 1, wherein the body comprises one or more resizing perforations that extend transverse to the fold.

15. The tamper-evident bag seal of claim 14, further comprising liners that cover the adhesive structure on the bag facing side of the first flap and the adhesive structure on the bag facing side of the second flap to prevent the adhesive structures from sticking to the bag until the liners are removed, the liners comprising one or more resizing perforations that extend transverse to the fold that align with one or more resizing perforations of the body.

16. A method of using a tamper-evident bag comprising:

providing a bag having a bottom, a first side wall, a second side wall and two opposing end walls that form an opening;

providing tamper-evident bag seal comprising:

a body having a first end and a second end and a first side and a second side and having a length as measured between the first end and the second end and a width as measured between the first side and the second side, the body comprising a first flap and a second flap with the first and second flaps having a bag facing side and an outward facing side;

a fold between the first flap and the second flap, the fold having one or more perforated sections; and an opening provided in a center portion of the body along the fold and between the first flap and the second flap, the opening formed between the first flap and the second flap such that the first flap has at least one tab extending from the first flap along the fold and the second flap has at least one tab extending from the second flap along the fold;

inserting contents into the opening of the bag;

attaching the bag facing side of the first flap of the body of the tamper-evident bag seal to the first side wall of the bag proximate to the opening;

folding the body of the tamper-evident bag seal over the opening of the bag such that the at least one tab of the first flap and the at least one tab of the second flap extend upward from the fold; and attaching the bag facing side of the second flap of the body of the tamper-evident bag seal to the second side wall of the bag such that the fold extends above an opening of the bag and the at least one tab of the first flap and the at least one tab of the second flap provide grips for tearing the body along the one or more perforated sections to access the opening of the bag.

17. The method according to claim 16, further comprising pulling the at least one tab of the first flap and the at least one tab of the second flap away from each other to tear the body along the one or more perforated sections to access the opening of the bag.

18. The method according to claim 16, wherein the tamper evident bag seal further comprises:

an adhesive structure on the bag facing side of the first flap and an adhesive structure on the bag facing side of the second flap, liners that cover the adhesive structure on the bag facing side of the first flap and the adhesive structure on the bag facing side of the second flap to prevent the adhesive structures from sticking to the bag until the liners are removed, the liners extending upon at least one of the first end or the second end of the body of the tamper-evident bag seal.

19. The method according to claim 16, wherein the step of attaching the bag facing side of the first flap of the body of the tamper-evident bag seal further comprises removing the liner from the adhesive structure on the bag facing side of the first flap and pressing the first flap and the adhesive structure against the first side wall of the bag; and the step of attaching the bag facing side of the second flap of the body of the tamper-evident bag seal further comprises removing the liner from the adhesive structure on the bag facing side of the second flap and pressing the second flap and the adhesive structure against to the second side wall of the bag.

20. The method according to claim 16, wherein the body of the tamper-evident bag seal comprises one or more resizing perforations that extend transverse to the fold and further comprising:

tearing the tamper-evident bag seal along at least one of the one or more resizing perforations to resize the tamper-evident bag seal to fit the size of the bag.

* * * * *